US008711004B2

(12) United States Patent
Gabara et al.

(10) Patent No.: US 8,711,004 B2
(45) Date of Patent: Apr. 29, 2014

(54) METHOD AND APPARATUS FOR REDUCING AND CONTROLLING HIGHWAY CONGESTION TO SAVE ON FUEL COSTS

(75) Inventors: Cassandra Marlene Gabara, Murray Hill, NJ (US); Thaddeus John Gabara, Murray Hill, NJ (US)

(73) Assignee: TrackThings LLC, Murray Hill, NJ (US)

( * ) Notice: Subject to any disclaimer, the term of this patent is extended or adjusted under 35 U.S.C. 154(b) by 1096 days.

(21) Appl. No.: 12/651,471

(22) Filed: Jan. 3, 2010

(65) Prior Publication Data

US 2011/0163893 A1 Jul. 7, 2011

(51) Int. Cl.
*B60Q 7/00* (2006.01)

(52) U.S. Cl.
USPC ..... 340/908.1; 340/908; 340/932.2; 404/6; 404/9

(58) Field of Classification Search
USPC ..... 340/908–908.1; 404/6, 9–13
See application file for complete search history.

(56) References Cited

U.S. PATENT DOCUMENTS 2,143,433 A * 1/1939 Curtis ..... 404/1
2,260,051 A * 10/1941 Pardee ..... 404/12
2,528,962 A * 11/1950 Lieutard ..... 116/63 P
2,931,279 A * 4/1960 Wiswell ..... 404/13
3,245,327 A * 4/1966 Wasley ..... 404/12
3,391,620 A * 7/1968 Mahoney ..... 404/6
3,530,775 A * 9/1970 Bowersox ..... 404/9
4,004,857 A * 1/1977 Eschen, Jr. ..... 404/6
4,624,601 A * 11/1986 Quittner ..... 404/12
4,629,357 A * 12/1986 Wattenburg et al. ..... 404/6
4,632,598 A * 12/1986 Richards ..... 404/6
4,653,954 A * 3/1987 Booth et al. ..... 404/6
4,666,332 A * 5/1987 Burgett ..... 404/6
4,690,583 A * 9/1987 Faulconer ..... 404/6
RE33,201 E * 4/1990 Dickinson ..... 404/6
4,974,990 A * 12/1990 Anderson et al. ..... 404/94
5,097,790 A * 3/1992 Massey ..... 116/63 P
6,036,249 A * 3/2000 Kuntz ..... 296/1.04
6,317,058 B1 * 11/2001 Lemelson et al. ..... 340/910
6,474,903 B1 * 11/2002 Marts et al. ..... 404/6
6,632,044 B2 * 10/2003 Duckett ..... 404/6

(Continued)

OTHER PUBLICATIONS

Biofuels for Transportation, US Dept. of Energy, http://genomicscience.energy.gov/biofuels/transportation.shtml, copied Jan. 2, 2010.

(Continued)

*Primary Examiner* — Daniel Wu
*Assistant Examiner* — Son M Tang
(74) *Attorney, Agent, or Firm* — Thaddeus Gabara; Tyrean Patent Prosecution Law Firm

(57) ABSTRACT

One estimate indicates that rubbernecking and congestion consumes about 4% of this country's fuel. Two approaches are presented to help solve this problem. The first uses shields to block the view of a car accident. Rubbernecking is reduced since the visibility of the car accident is reduced. A second approach uses mobile flat units that can be remotely controlled to enter a roadway that is carrying active traffic. The traffic runs over these units that are being moved until the master processor indicates that the mobile flat units are in position. A post is extended from the flat unit that issues commands to the motorists so the master processor can begin to control and reduce congestion. Both approaches can be used to help decrease fuel waste in the US.

13 Claims, 14 Drawing Sheets

(56) References Cited

U.S. PATENT DOCUMENTS

| | | | | |
|---|---|---|---|---|
| 6,633,238 | B2 * | 10/2003 | Lemelson et al. | 340/909 |
| 6,969,185 | B1 * | 11/2005 | Adair | 362/542 |
| 6,984,088 | B1 * | 1/2006 | Krivoy | 404/6 |
| 7,098,807 | B2 * | 8/2006 | Seguin et al. | 340/907 |
| 7,168,881 | B2 * | 1/2007 | Hartlauer | 404/6 |
| 7,600,554 | B1 * | 10/2009 | Wright et al. | 160/327 |
| 2001/0048845 | A1 * | 12/2001 | Jack | 404/6 |
| 2006/0249091 | A1 * | 11/2006 | Orbach | 119/169 |
| 2011/0163893 | A1 * | 7/2011 | Gabara et al. | 340/908.1 |
| 2013/0048227 | A1 * | 2/2013 | Cannova | 160/10 |

OTHER PUBLICATIONS

CNN.com/travel, http://archives.cnn.com/2002/TRAVEL/NEWS/06/20/traffic.jam/index.html, Jun. 20, 2002.

* cited by examiner 9-1

| | Fuel Spent (annually) | Hours Wasted (annually) | Cost of congestion (annually) |
|---|---|---|---|
| All fuel in US (in 2004) | 140 billion gallons | ------- | ------- |
| During a traffic jam (in 75 largest metropolitan areas) | 5.7 billion gallons | 62 hours | $1,000/ person |

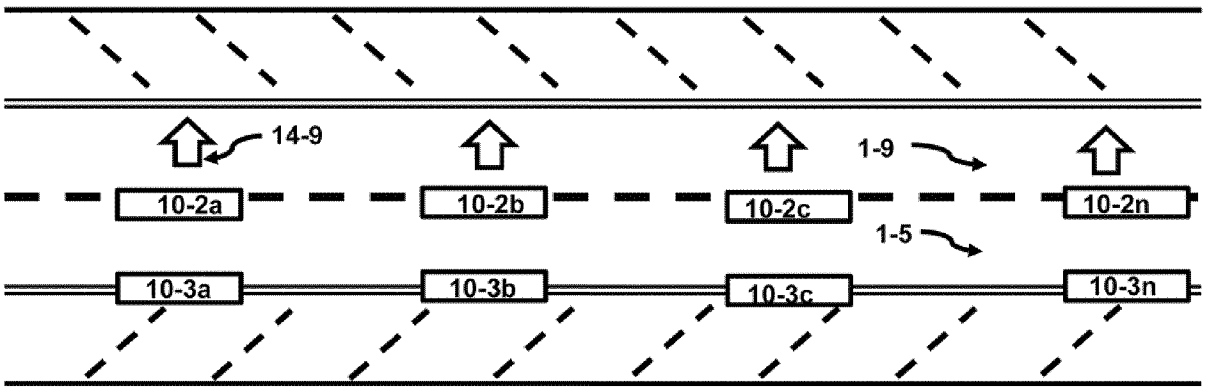
FIG. 14b 14-8
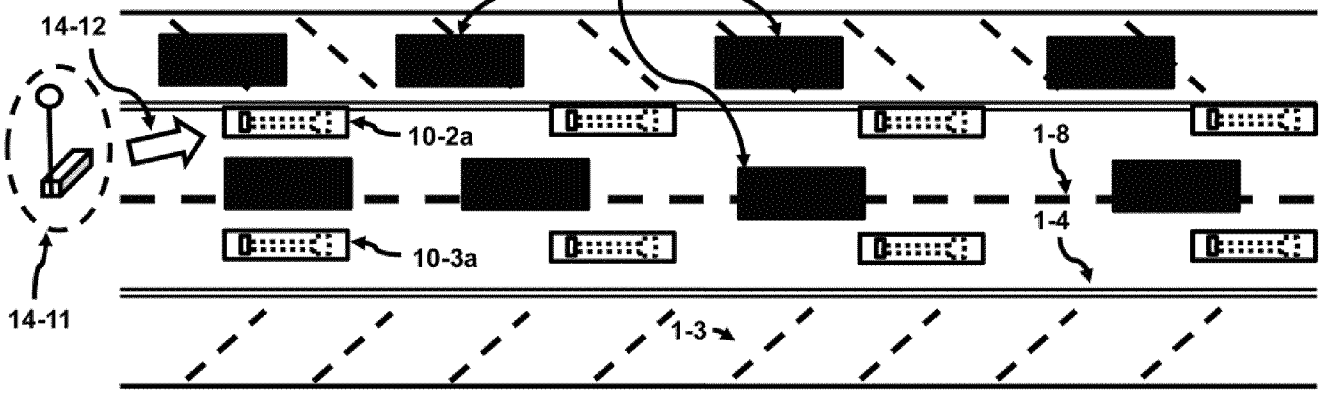
FIG. 14c 14-10

METHOD AND APPARATUS FOR REDUCING AND CONTROLLING HIGHWAY CONGESTION TO SAVE ON FUEL COSTS

BACKGROUND OF THE INVENTION

When congestion or rubbernecking occurs on major highways, vehicles stand still and idle their engines. As the congestion builds up, the wait time increases. The congestion wastes fuel and aggravates the driver's nerves.

Often it is the drivers own curiosity that helps to fuel the delay which is known as rubbernecking. As the name implies, rubbernecking refers to the action of passing drivers or motorists who divert their attention from the roadway in front of them to the unusual situation that is existing within eyeshot of the driver. This unusual situation can be a car accident, a hit pedestrian, road construction, road repair, a patrol car that pulled over a motorist, or some other disturbance. Because the driver is drawn to the disturbance, the driver must slow the car down to get a better view, and this leads to what is known as "rubbernecking."

It is a desire of this invention to address several issues regarding rubbernecking; 1) find a way to decrease the wait time, 2) decrease waste of fuel, and 3) attempt to remove the need to rubberneck.

Here are some fuel expenditure conditions in the US, as illustrated in FIG. 9. Almost 140 billion gals of fuel is used in the US. During a traffic jams, the study estimates, that in 75 of the largest metropolitan areas, almost 6 billion gals are wasted in traffic jams. Not to mention the time that is wasted waiting in a traffic jam.

A desirable feature of this invention would be to deter the need to perform rubbernecking. In addition, another feature of this invention would be to control the traffic flow while in a congested state to decrease the congestion.

BRIEF SUMMARY OF THE INVENTION

This invention relates to the idea of replacing the view of the accident with a second view that lacks detail. Ideally, this second view should be applied uniformly across a region of the country to substitute the disturbance with this commonly known second view. It is important to point out that this invention would decrease rubbernecking gradually since the need for rubbernecking should secede after a period of time because the reward of rubbernecking will not provide a visual of the unusual situation, instead the second view will be shown. Once this second view is accepted by all drivers in this region of the country, the drivers will tend to disregard the need to rubberneck.

The second view is a quickly erected shield that blocks the view of the disturbance from the passing drivers. This shield could have standardized appearance, but the net result will be that the driver would not be able to see disturbance. Features such as color, width and height of the shield or shields can be resolved to provide for better uniformity of the second view. As the uniformity improves, there will be a lesser chance for the driver or motorist to slow down.

One way of erecting the second view is by filling balloons with helium which in turn lifts shields to block the disturbance. The bottom end of the shield will have a counter weight to hold the base of the shield against the ground. In case of stiff cross winds, the ends of the shield can further be help in place by additional wires quickly connected to local support.

Another aspect of this invention is to control the flow of congested traffic in real time. Wirelessly controlled mobile flat units can be placed on the shoulder of the road and then moved onto the roadway remotely controlled by a master unit. As these flat units are moved onto the roadway, the congested traffic can run over these flat units without damaging them. Once these units are in position, a signal is given to raise or extend a reflective, illuminated post which also has an LCD (Liquid Crystal Display) display. This spacing of these marked posts defines and establishes a new dynamically adjusted roadway. As the traffic follows these roadways, the congestion becomes reduced until it is eliminated.

After the congestion is eliminated, the marked posts are slowly moved by the processor unit until the new sets of lanes superimpose the original set of lanes in the roadway. Then, the posts are lower or retracted and the units moved to the shoulder of the road for future reuse.

Another aspect of this invention is that the marked posts are positioned with the guidance of a master processor that has the details of the roadway in memory. The memory can be in the master processor or located on a web server. If the master processor knows; 1) which roadway is blocked, 2) the location of the accident, and 3) the positioning of the mobile flat units, the master processor issues instructions to the mobile units to optimize and reduce the flow of the congested traffic.

Once the shields are in place and the reward of rubbernecking is reduced, the traffic will become less affected by the rubbernecking event and the waste of fuel waiting in long traffic lines can be decreased. In addition, because of the active control of congested traffic, the ability to control and reduce congestion offers another approach to improving fuel usage in the US.

Another preferred embodiment of the preferred invention includes an apparatus that blocks the view of a vehicular accident by a passing motorist comprising: at least one shield, such that the shield is located between the vehicular accident and the passing motorist, whereby the shield is juxtaposed to a concrete barrier, whereby the shield is juxtaposed to the vehicular accident, whereby the shield is an inflatable structure defining a thin rectangular structure, whereby the shield is plastic.

Another preferred embodiment of the preferred invention includes an apparatus comprising: a plurality of mobile flat units, a master processor that controls a movement of the mobile flat units, a highway having more than one lane and a new set of lanes defined by a final position of the mobile flat units, further comprising: a communication channel established between the master processor and each of the flat units, whereby the communication channel can be wired or wireless between the mobile flat units and the master processor, further comprising: a motor to move the mobile flat units: a local processor coupled to the motor and a wireless block to control the motor based on a command received from the master processor, further comprising: a plurality of rubber tracks coupled to the motor and a road, whereby a post in the plurality of mobile flat units is extended at the final position, further comprising: the post in the plurality of mobile flat units can be retracted during the movement, further comprising: at least one LCD (Liquid Crystal Display) or LED (Light Emitting Diode) that can display instructions.

Another preferred embodiment of the preferred invention includes a method of creating a new set of lanes comprising the steps of: placing a plurality of mobile flat units in an initial position, controlling a movement of the mobile flat units over a roadway by using a master processor, moving the mobile flat units to a final position and creating the new set of lanes defined by the final position of the mobile flat units, further comprising: communicating information either wired or wirelessly between the master processor and each of the mobile flat units, whereby the initial position is located in a shoulder of the highway. The method further comprising: extending a post in the mobile flat units when they are in the final position, further comprising: moving the mobile flat units slowly so that the new set of lanes superimpose the original set of lanes in the roadway, retracting the post in the mobile flat units and moving the mobile flat units off the active portion of the highway, further comprising: providing motorists with instructions printed on a display screen located on the post.

BRIEF DESCRIPTION OF THE DRAWINGS

Please note that the drawings shown in this specification may not be drawn to scale and the relative dimensions of various elements in the diagrams are depicted schematically and not to scale.

FIG. 11*b* illustrates the top view of a mobile flat unit that has the marked post extended.

FIG. 14*b* shows the top view of the southbound lanes of FIG. 10 with the mobile flat units being positioned.

FIG. 14*c* illustrates the top view of the southbound lanes of FIG. 10 with the mobile flat units in position and posts extracted to control traffic flow dynamically.

DETAILED DESCRIPTION OF THE INVENTION

Figure 1:
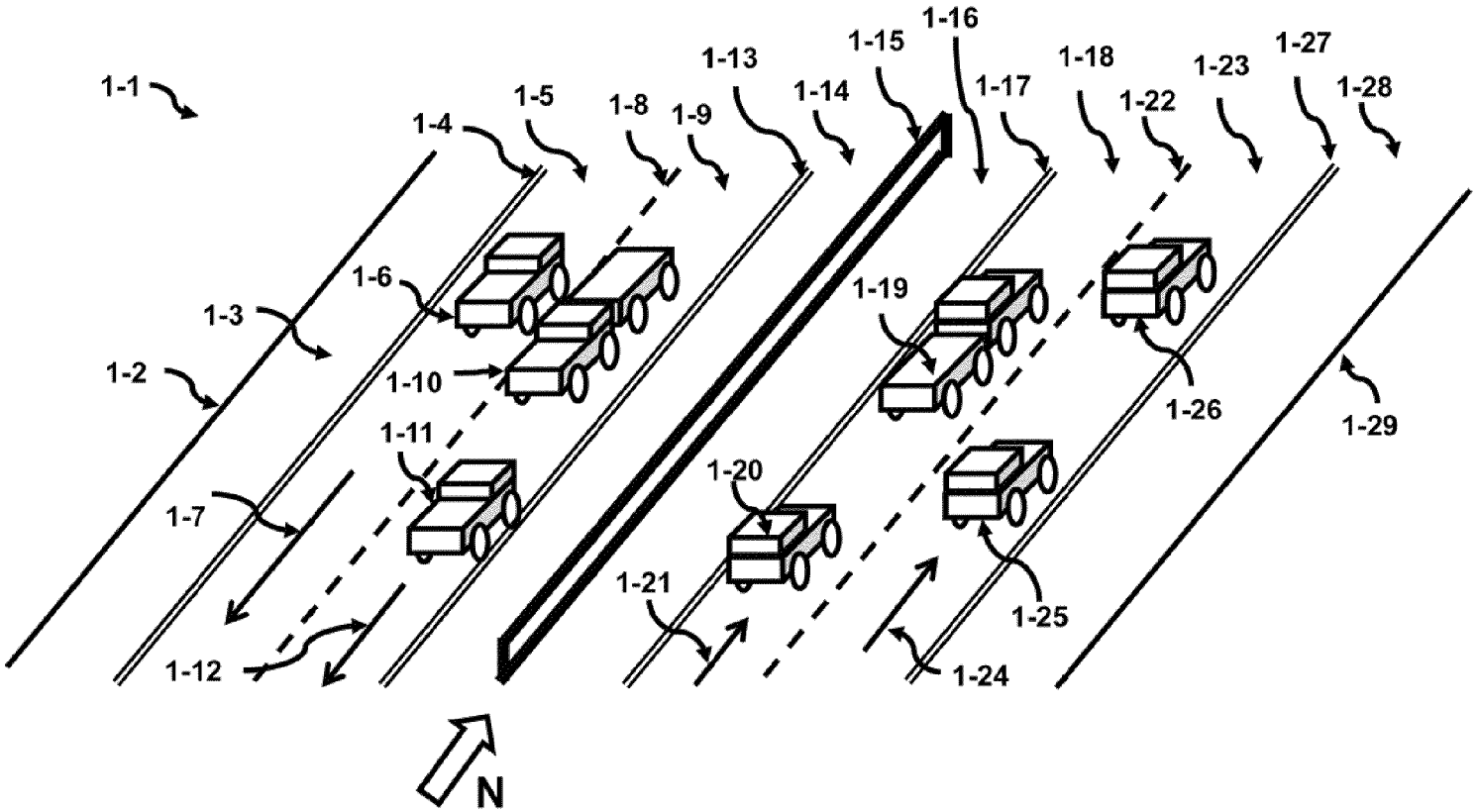
FIG. 1 (prior art)
FIG. 1 shows a typical major throughput highway.

FIG. 1 illustrates a view of a typical highway or interstate 1-1. The highway is bounded by 1-2 and 1-29 which defines the paved region of the highway. This highway 1-1 stretches from North to South as shown by the arrow. The highway has four paved lanes 1-16, 1-18, 1-23 and 1-28 heading North and has four paved lanes 1-3, 1-5, 1-9 and 1-14 heading South. The North and South directions are separated by the concrete barrier 1-15. Each of the two outer lanes of the North and South directions serve as shoulders. The inner shoulders of the North and South directions are 1-16 and 1-14, respectively. The outer shoulders the North and South directions are 1-28 and 1-3, respectively. The active portion of the highway comprises lanes 1-18 and 1-23 traveling North and the lanes 1-5 and 1-9 traveling South.

The various lanes are separated by barriers, markings, depressions, or lines for demarcation purposes. For instance, the lanes that are traveling South 1-3, 1-5, 1-9 and 1-14 are bordered by markings 1-2, 1-4, 1-8, 1-13, and 1-15, respectively and the lanes traveling North 1-16, 1-18, 1-23 and 1-28 are bordered by markings 1-15, 1-17, 1-22, 1-27 and 1-29, respectively. The markings 1-4, 1-13, 1-17 and 1-27 may have rumble strips formed in them to make the characteristic sound once the tires rolls over them. The barrier 1-15 separates the North from the South lanes as mentioned earlier. The dotted lines 1-8 and 1-22 separate the two active portions in each direction into two lanes.

The northbound traffic has moving vehicles 1-19 and 1-20 traveling at velocity 1-21. While vehicles 1-25 and 1-26 are traveling at velocity 1-24. In the southbound lanes vehicle 1-6 is traveling at velocity 1-7 while vehicles 1-10 and 1-11 are traveling at velocity 1-12. Although it is not necessary for both vehicles in the same lane to travel at the same velocity at all times. Also note that a vehicle can be any moving vehicle such as a motorcycle, car, truck, van, scooter, tractor trailer, 18 wheeler or tandem rig.

The shoulders 1-3, 1-14, 1-16 and 1-28 are used to decelerate any vehicles traveling on the active portion of the highway for emergency care (typically when the car starts to fail in operation, a fender bender or minor collision) or unavoidable stoppage (police request) or for any other need to stop a vehicle.

Figure 2:
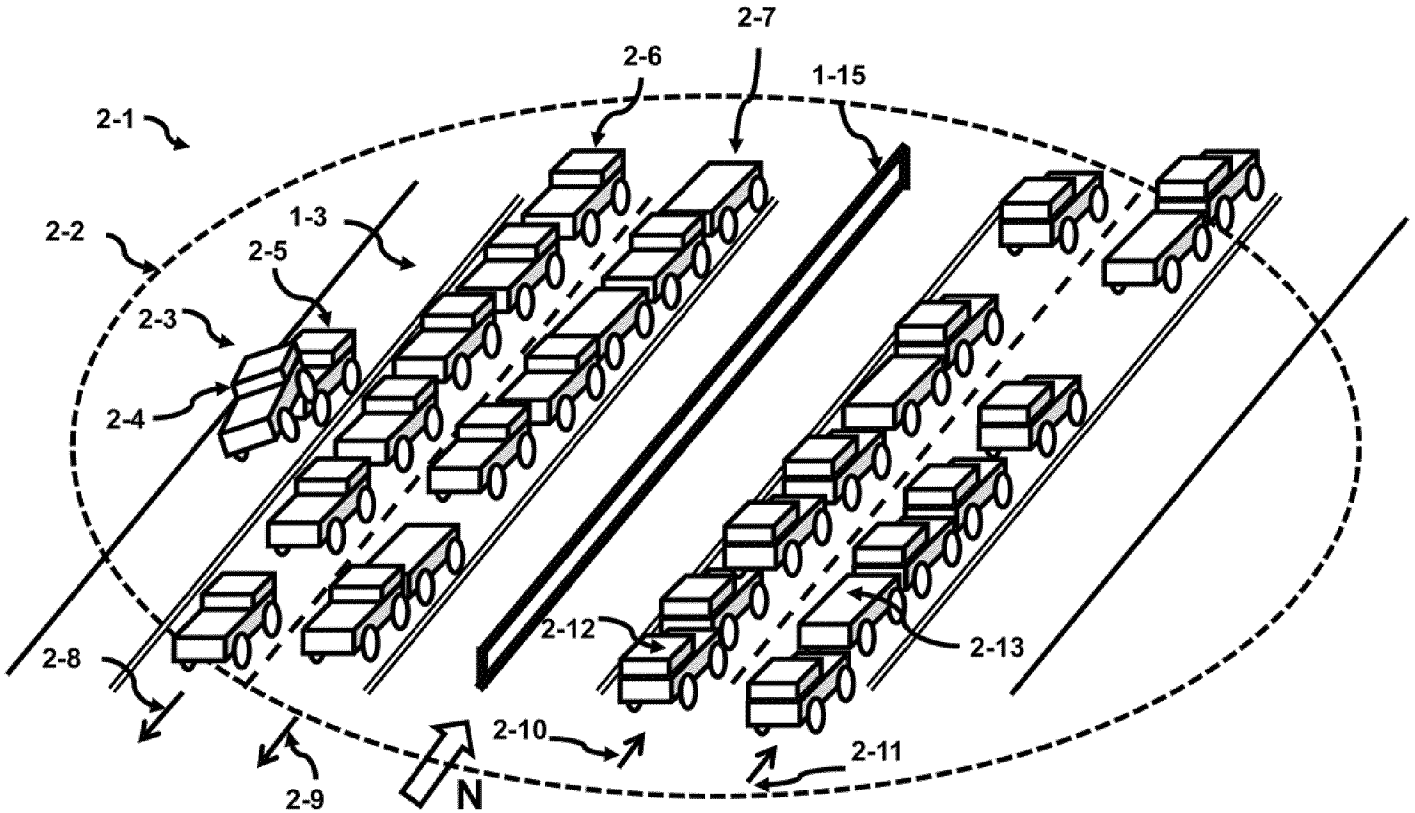
FIG. 2 (prior art)
FIG. 2 illustrates a traffic accident located in the shoulder of the road and the rubbernecking that starts to form.

FIG. 2 illustrates a view of a typical highway or interstate 2-1 after an accident 2-3 in the outer shoulder 1-3 between two vehicles 2-4 and 2-5. Rubbernecking lines 2-6 and 2-7 start to build up in the Southbound lanes before the accident as those who are passing the accident want to slow down to get a better view. As these vehicles slow down, the following vehicles start forming rubbernecking lines 2-6 and 2-7 since the traffic before them has slowed down. The vehicles assume a bumper to bumper configuration. Likewise, in the northbound direction, rubbernecking lines 2-12 and 2-13 starts to form. All of these vehicles desire a view of the disturbance or accident so they slow down. The dotted region 2-2 is used and indicated in FIG. 3.

Figures 3, 5:
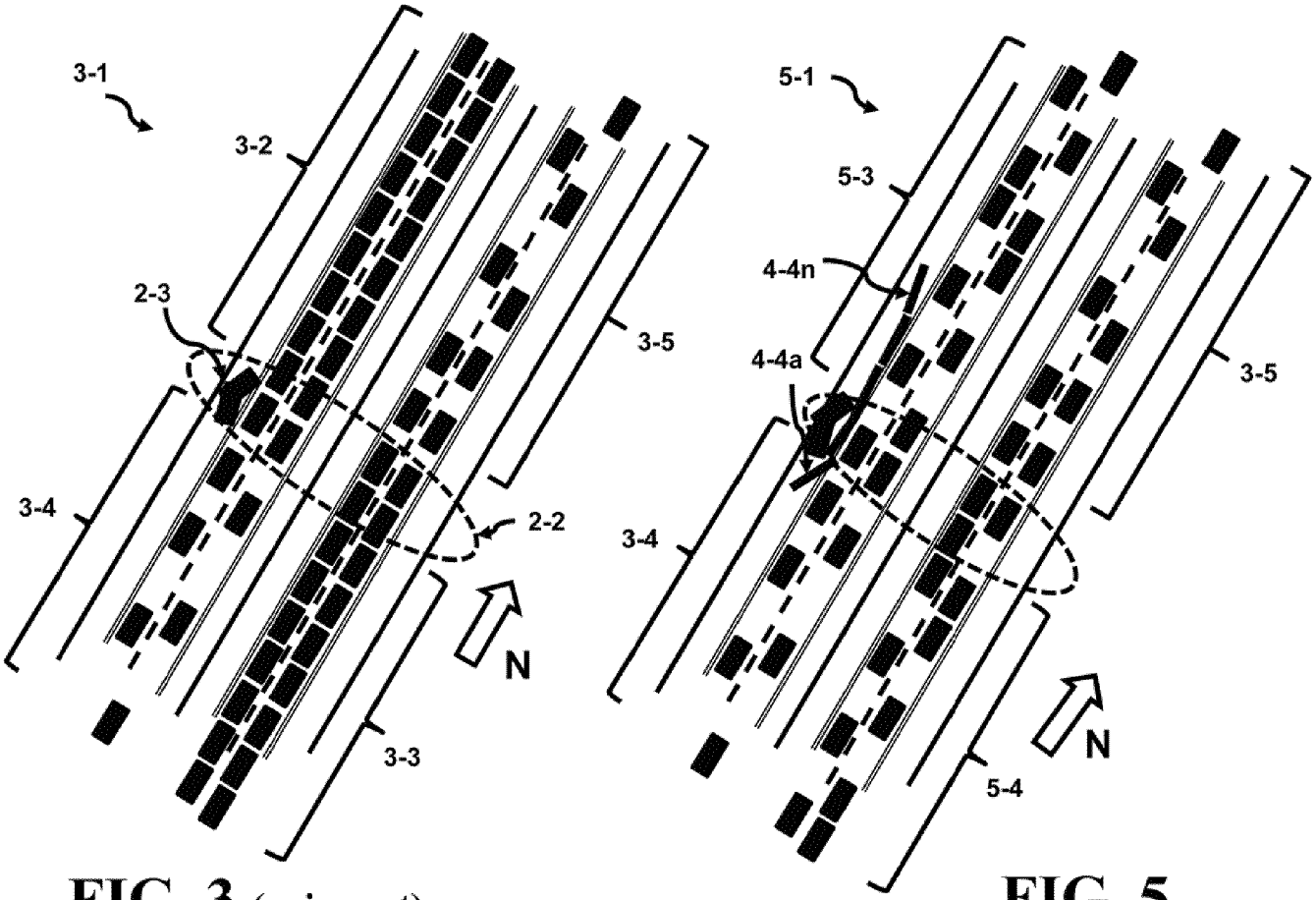
FIG. 3 (prior art)
FIG. 3 depicts a top view of the highway shown in FIG. 1.
FIG. 5 depicts the top view of the highway shown in FIG. 4*a* illustrating the decrease in rubbernecking of this inventive technique.

Depending on the time of day, (for example, weekdays 8 AM or 5 PM) the rubbernecking traffic can build up quickly. FIG. 3 illustrates the bird's eye view 3-1 of FIG. 2 from above. Note that dotted region 2-2. The accident is at 2-3. The rubbernecking lines are illustrated in regions as 3-2 and 3-3 for the southbound and northbound lanes, respectively. The length of these rubbernecking lines could extend for several miles. Most cars in the rubbernecking lines are standing still or moving very slowing and are wasting fuel whether the fuel is gasoline, diesel, chemical reactions, or electric charge. In addition, besides the waste of fuel, each motorist is stretched to the edge of their patience of just waiting in the rubberneck or congested line. After the vehicles pass the accident, the traffic starts to move again as illustrated in regions 3-4 and 3-5 where the spacing between vehicles increases again.

Figure 4A:
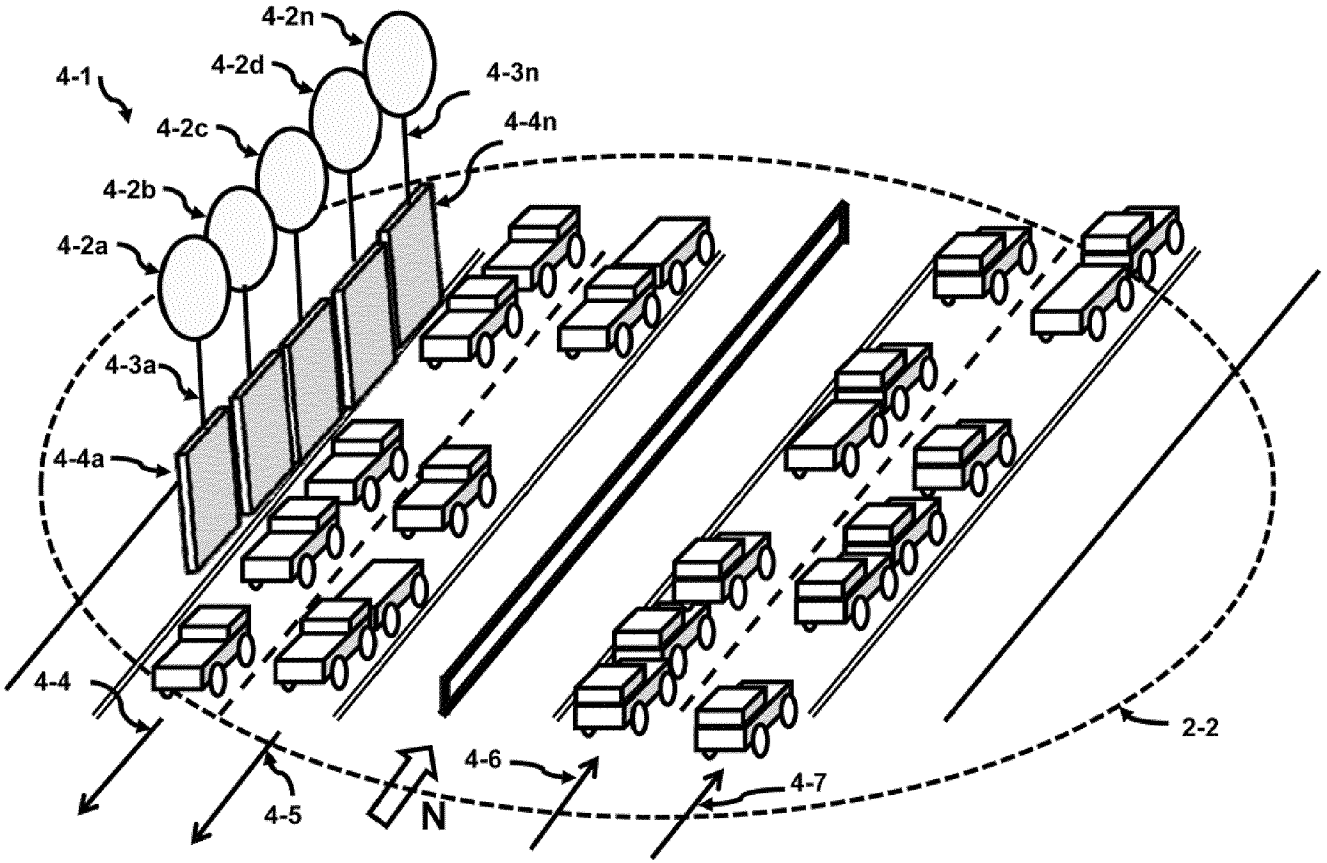
FIG. 4*a* shows the inventive technique being applied to FIG. 2 to conceal the traffic accident from rubberneckers.

FIG. 4*a* illustrates the inventive technique of using shields to block the details of the accident 2-3 which is behind the shields 4-4*a* through 4-4*n*. The shields are connected to the balloons by wires 4-3*a* through 4-3*n* and are lifted by helium balloons 4-3*a* through 4-3*n*. Another possibility is for a shield that can be constructed so that it can hold helium eliminating the need for the wires and balloons. Ideally, the traffic would be flowing in the northern directions at velocities 4-6 and 4-7 and in the southern directions at velocities 4-4 and 4-5. These velocities should be larger than the velocities given for FIG. 2 without the shields in place.

A bird's eye view of FIG. 4*a* is given in FIG. 5. Due to the shields 4-4*a* through 4-4*n* and the lack of information to rubberneckers, the motorists will not slow sown to view just a shield, although they may slow slightly to drive with caution. The "rubbernecking" lines indicated in the regions 5-3 and 5-4 have been improved in that not all cars are bumper to bumper and the traffic flow improves.

Figure 4B:
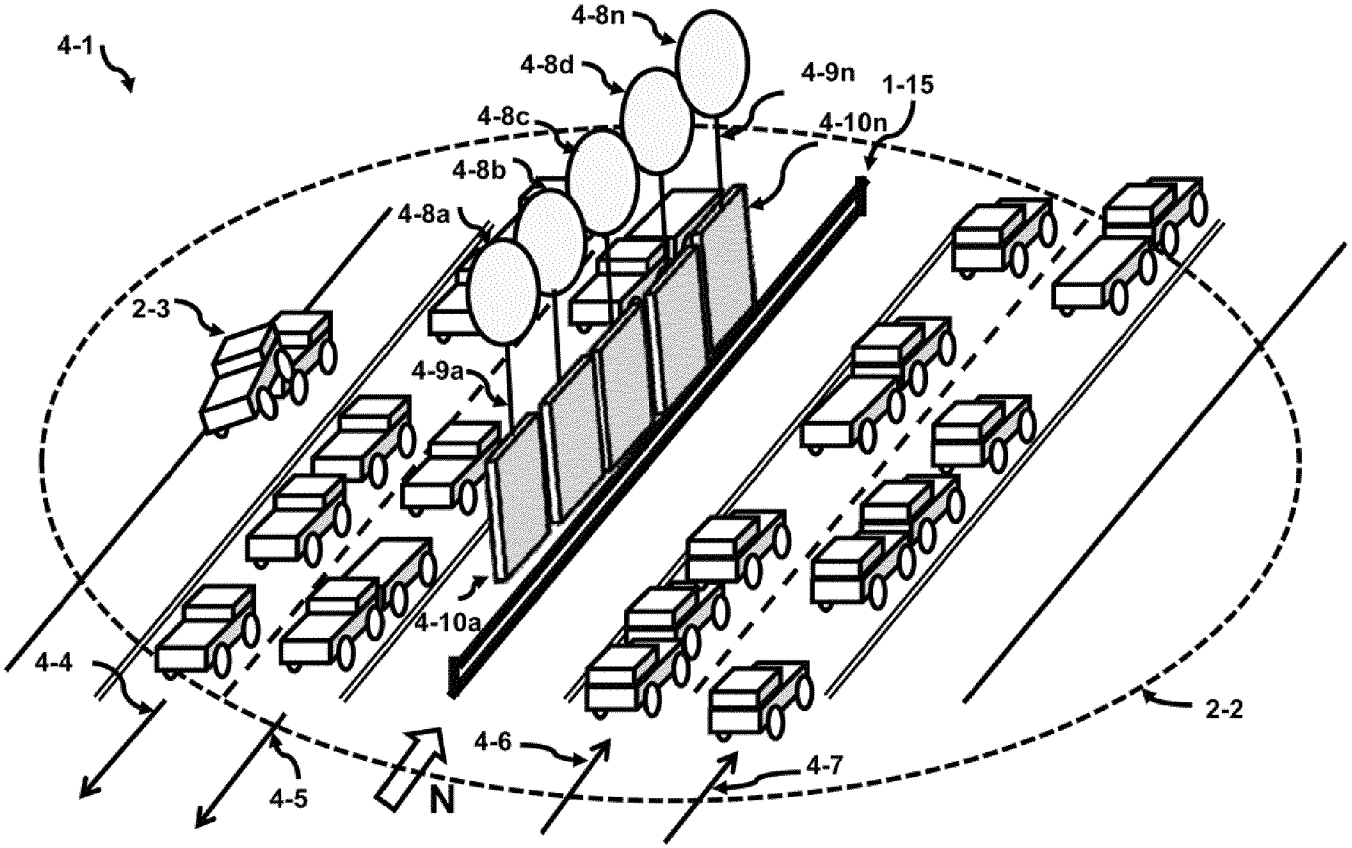
FIG. 4*b* shows the inventive technique being applied to FIG. 2 a second way to conceal the traffic accident from rubberneckers.

FIG. 4*b* illustrates a second inventive technique of using shields to block the details of the accident 2-3. The shields 4-4*a* through 4-4*n* are now placed juxtaposed to the barrier 1-15. The shields are connected to the balloons by wires 4-3*a* through 4-3*n* and are lifted by helium balloons 4-3 *a* through 4-3*n*.

Another possibility instead of balloons is to use light rigid shield extensions that fit over the barrier 1-15 to block the view of the northbound traffic. Although this solves half of the rubbernecking problem (only the northbound lane), the ability to position these shields could be performed very quickly.

Figure 6:
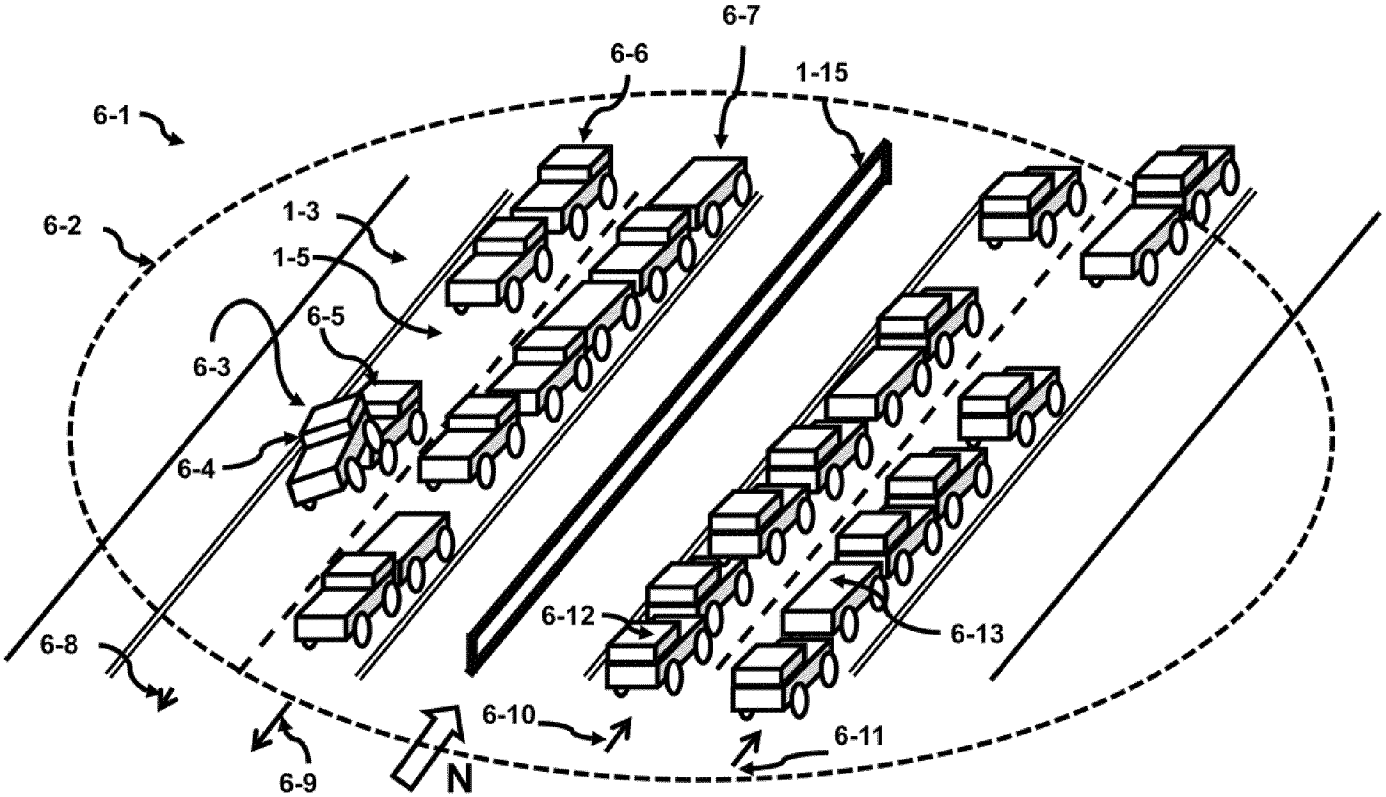
FIG. 6 (prior art)
FIG. 6 illustrates a traffic accident located directly in one of the lanes of the roadway and the rubbernecking that starts to form.

FIG. 6 shows a portion 6-2 of a road 6-1. An accident 6-3 between two vehicles 6-4 and 6-5 occurred in the outer southbound lane 1-5. The traffic flow 6-8 of the vehicles 6-6 is stopped. While the flow 6-9 of the traffic 6-7 is reduced due to rubbernecking and the traffic of the vehicles 6-6 trying to enter the inner lane. In the northbound lanes, the traffic flow 6-10 of the vehicles 6-12 and the traffic flow 6-11 of the vehicles 6-13 are reduced due to rubbernecking.

Figure 7:
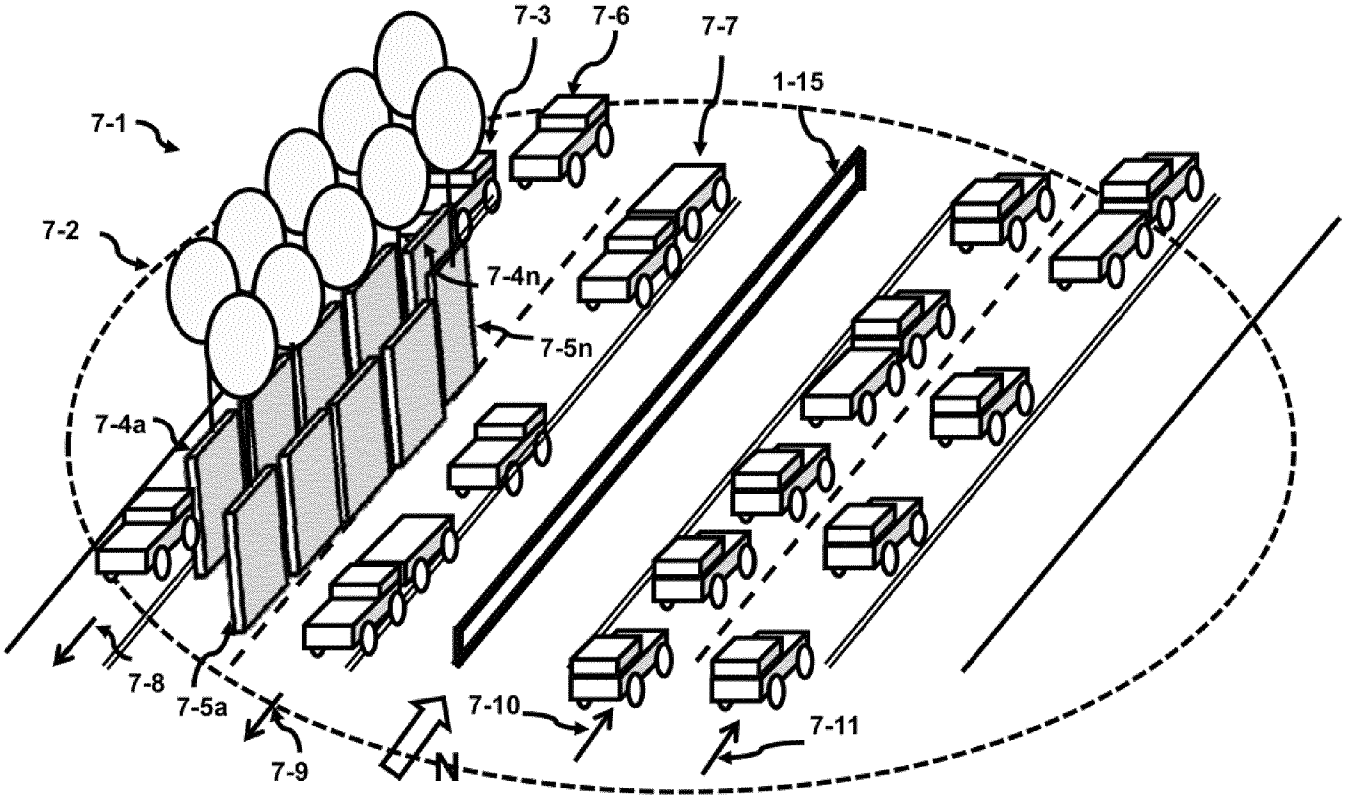
FIG. 7 shows the inventive technique being applied to FIG. 6 to conceal the traffic accident from rubberneckers.

FIG. 7 shows the inventive technique of using shields to block the details of the accident 6-3 which is behind the shields 7-4*a* through 7-4*n* and shields 7-5*a* through 7-5*n*. The shields are connected to the balloons by wires and are juxtaposed to the accident. New traffic patterns are established. The traffic flow 7-8 comprising vehicles 7-3 and 7-6 occur in the shoulder of the southbound lane. While the traffic flow 7-9 is formed by the vehicles 7-7. The northbound traffic flows of 7-10 and 7-11 due to the vehicles is reduced.

Figures 8, 9:
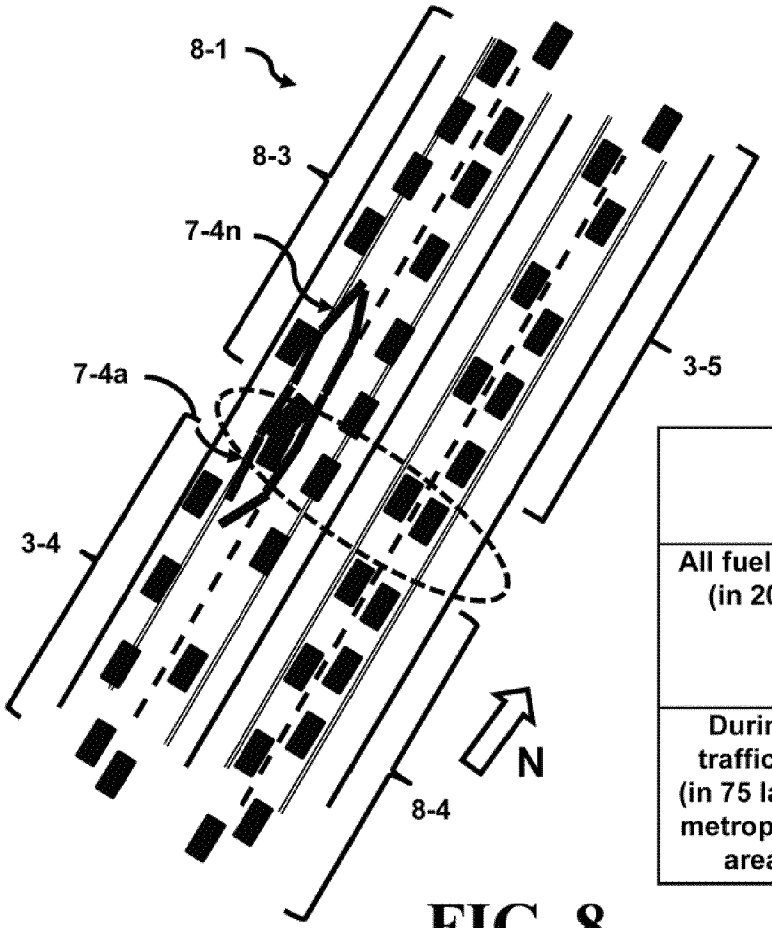
FIG. 9 (Prior Art)
FIG. 8 depicts the top view of the highway shown in FIG. 7 illustrating the decrease in rubbernecking of this inventive technique.
FIG. 9 shows a table illustrating the fuel usage in the US.

A bird's eye view 8-1 of FIG. 7 is given in FIG. 8. Due to the shields and the lack of information to rubberneckers, the vehicles begin forming new lanes before the accident in region 8-3. And due to the shields, the northbound lanes do not suffer a backup in region 8-4.

FIG. 9 provides a table illustrating the fuel usage in the US being almost 140 billion gals a year. Due to the traffic jams caused by rubbernecking and roadway congestion, almost 6 billion gals of fuel is wasted in the largest 75 metropolitan areas. According to the analysis of the 75 largest metropolitan areas by the Texas Transportation Institute in 2002, the average rush-hour driver wastes about 62 hours in traffic annually. The length of the average traffic jam has been increasing over the years. The Urban Mobility Report, from the Texas Transportation Institute, has indicated in 1982, traffic lasted for 4.5 hours a day in the 75 cities studied, however, in 2000, the traffic congestion time increased to seven hours a day.

Figure 10:
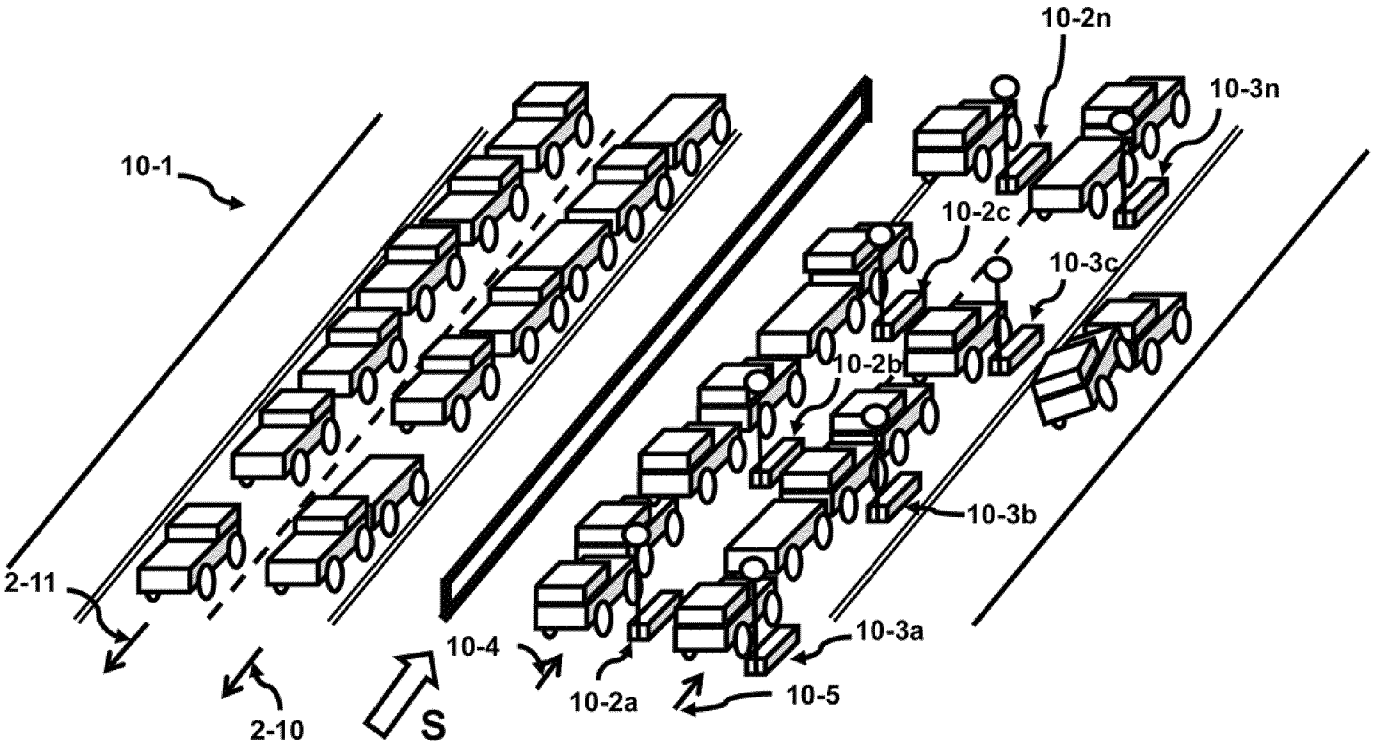
FIG. 10 shows the inventive technique being applied to FIG. 2 to control congestion building up in the roadway (note that the view is the southbound view of FIG. 2).

FIG. 10 illustrates the use of extended mobile flat units 10-2*a* to 10-2*n* and 10-3*a* to 10-3*n* after being placed in position to control traffic congestion 10-1. Note that this is the same scenario as shown in FIG. 2 but the view is from the southbound direction instead of the northbound direction. The flat units can be used in conjunction with the shields or each can be used alone to reduce traffic congestion. The traffic flows 10-4 and 10-5 in the southbound direction are controlled dynamically with the use of the mobile flat units.

Figure 11B:
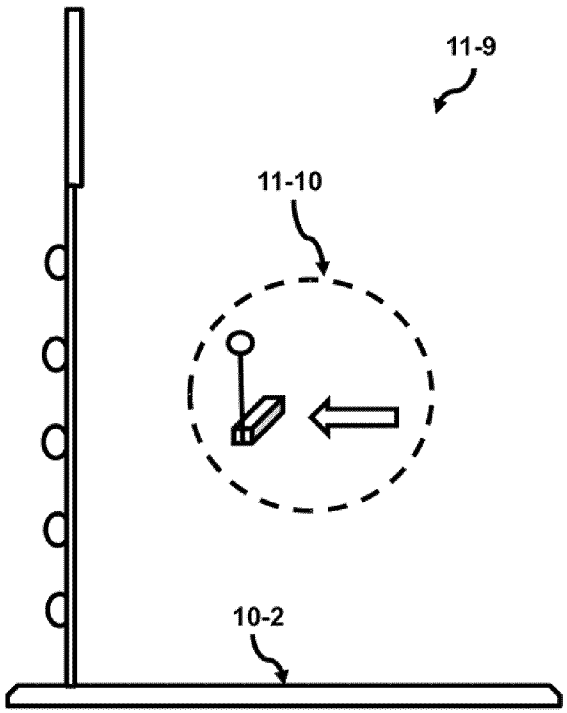
FIG. 11*b* shows the side view of a mobile flat unit that has the marked post extended.
Figure 11A:
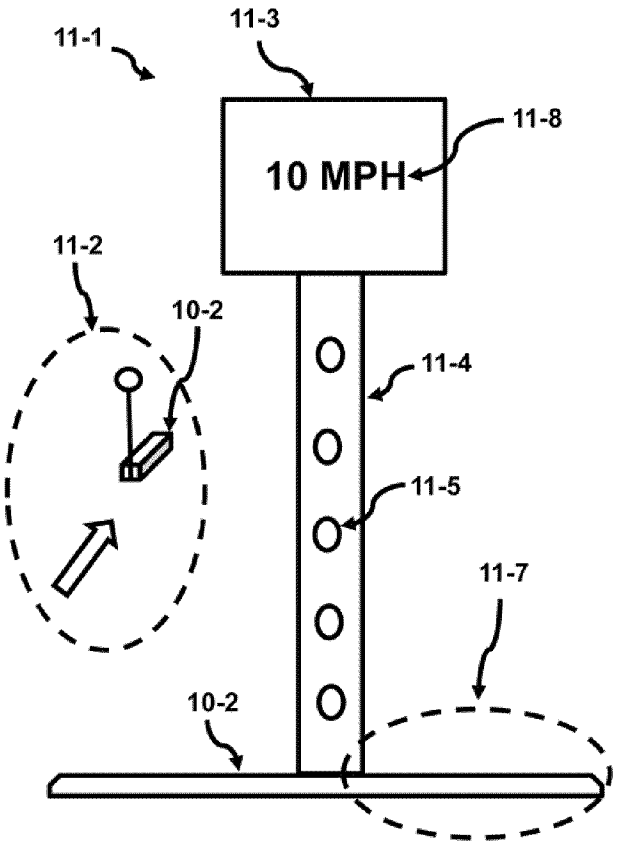
FIG. 11*a* depicts the front view of a mobile flat unit that has the marked post extended.

FIG. 11*a* shows an insert 11-2 presenting the front view of an extended mobile flat unit 10-2. The extended post 11-4 can have LED's (Light Emitting Diodes) 11-5 and reflective paint (not shown). The top of the post 11-3 has a display panel. The display panel can be an illuminated LCD or LED panel that can be used to display instructions 11-8. Some examples of instructions can include; 10 MPH, STOP, 5 MPH or any other instruction that can be directed to the motorists in the vehicles. The section 11-7 will be described later with regards to height, contents, durability, mobility, etc.

FIG. 11*b* depicts an insert 11-10 presenting the side view 11-9 of an extended mobile flat unit 10-2. The extended post 11-4 is viewed from the side.

Figure 11D:
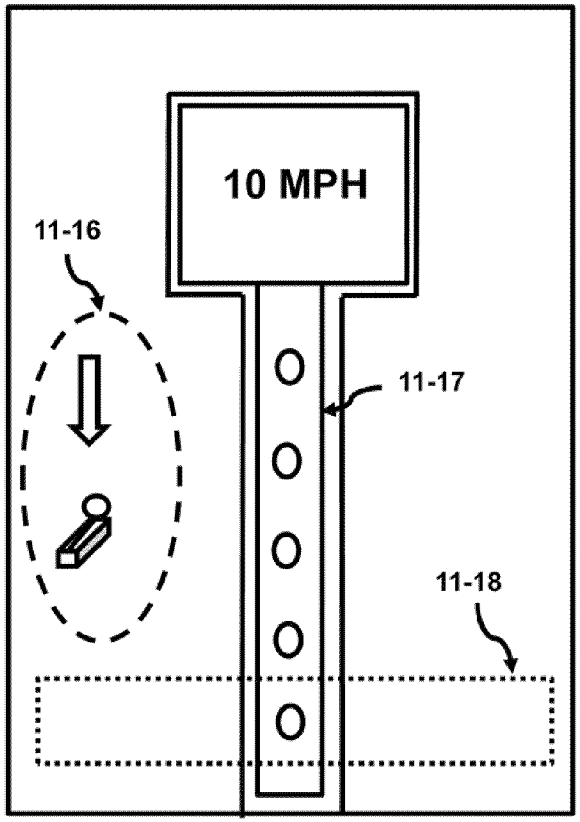
FIG. 11*d* depicts the top view of a mobile flat unit that has the post retracted into the recessed cavity.
Figure 11C:
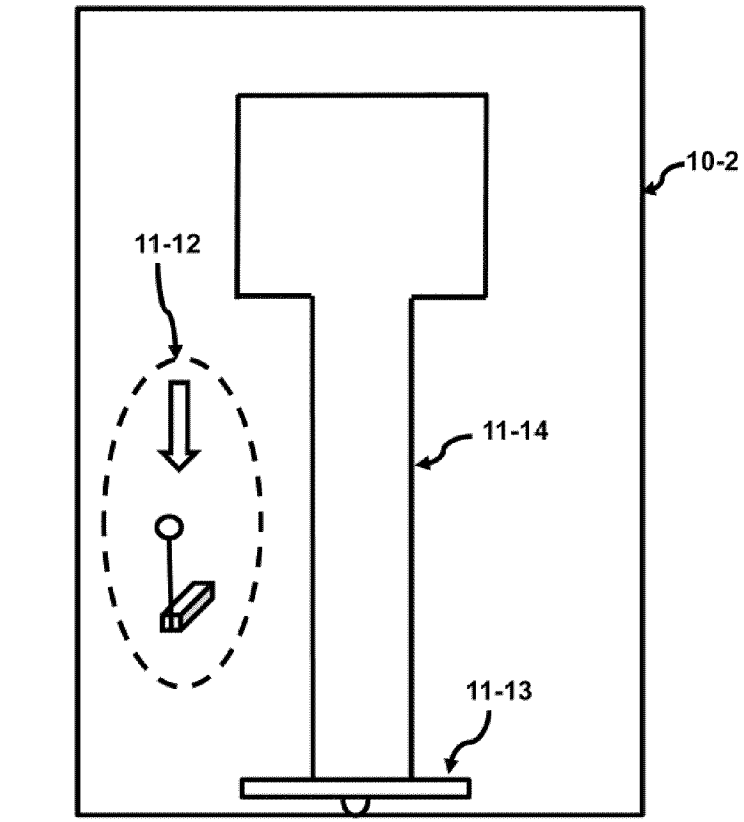
FIG. 11*c* depicts the top view of a mobile flat unit that has the marked post extended.

FIG. 11*c* illustrates an insert 11-12 presenting the top view 11-11 of an extended mobile flat unit 10-2. The extended post 11-13 is viewed from the top and a cavity 11-14 is embedded in the unit 10-2.

FIG. 11*d* shows an insert 11-16 presenting the top view 11-15 of a retracted mobile flat unit 10-2. Note that the post 11-17 is rotated into the recessed cavity 11-14 and prevents tires from damaging the retracted post when the tire rolls over the mobile unit 10-2. A dotted rectangle 11-18 illustrates one of the rubber tracks that are located beneath the unit 10-2.

Figure 12A:
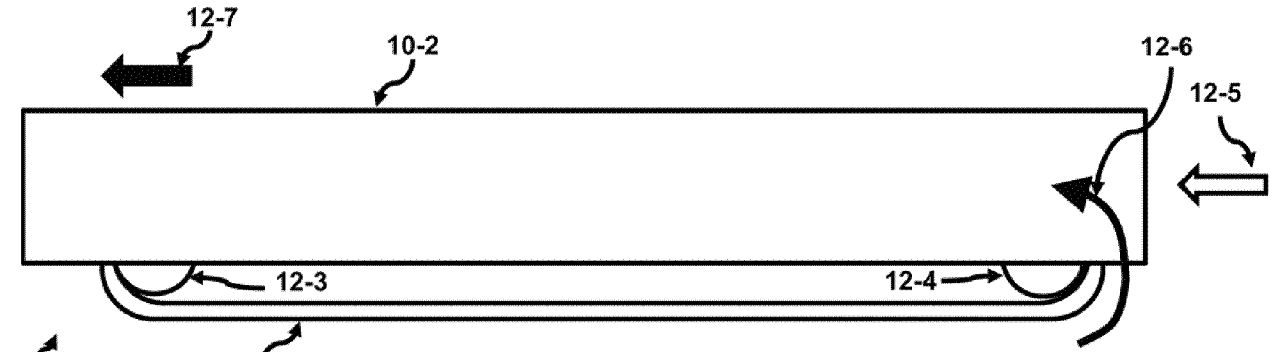
FIG. 12*a* illustrates the front view of a portion of a mobile flat unit illustrating the traction belt used to move the unit onto the roadway.

FIG. 12*a* depicts the front view 12-1 of a mobile flat unit 10-2. The rubber track 11-18 mentioned earlier is wrapped around two cylindrical shafts 12-3 and 12-4. As the shaft 12-4 rotates counterclockwise, the unit moves in the direction 12-7. The arrow 12-5 presents the side view shown next.

Figure 12B:
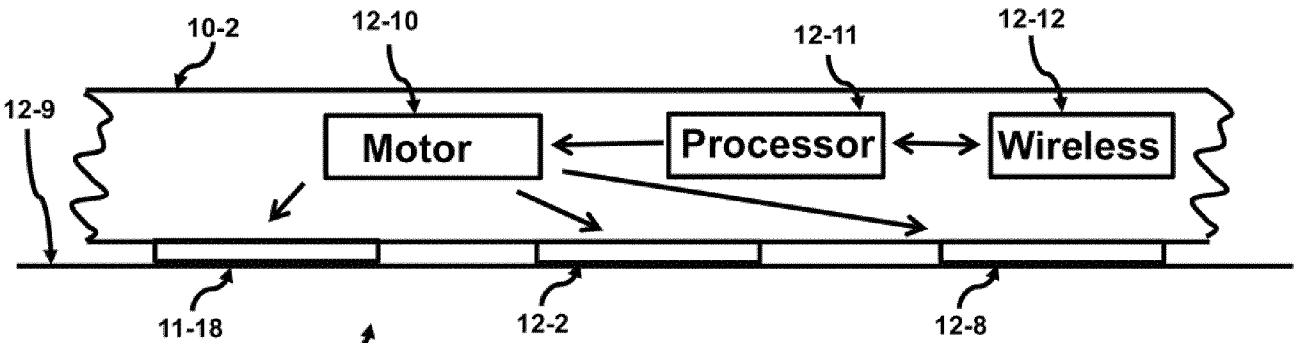
FIG. 12*b* shows the side view of a portion of a mobile flat unit and some of the electronics inside the unit.

FIG. 12*b* illustrates the side view 12-5 of a mobile flat unit 10-2. The rubber track 11-18 mentioned earlier as well as additional rubber tracks 12-2 and 12-8 are presented. The rubber tracks are shown in contact with the road 12-9. A local processor 12-11 receives/transmits instructions from/to the wireless block 12-12. The motor 12-10 controls the movement of the cylindrical shafts (not shown) which move the rubber tracks and thereby move the unit in/out of the page. Although not shown, the unit also contains all the components required to form the system. For example, batteries, memory, clocks that may be required but not shown.

Figures 13, 14A:
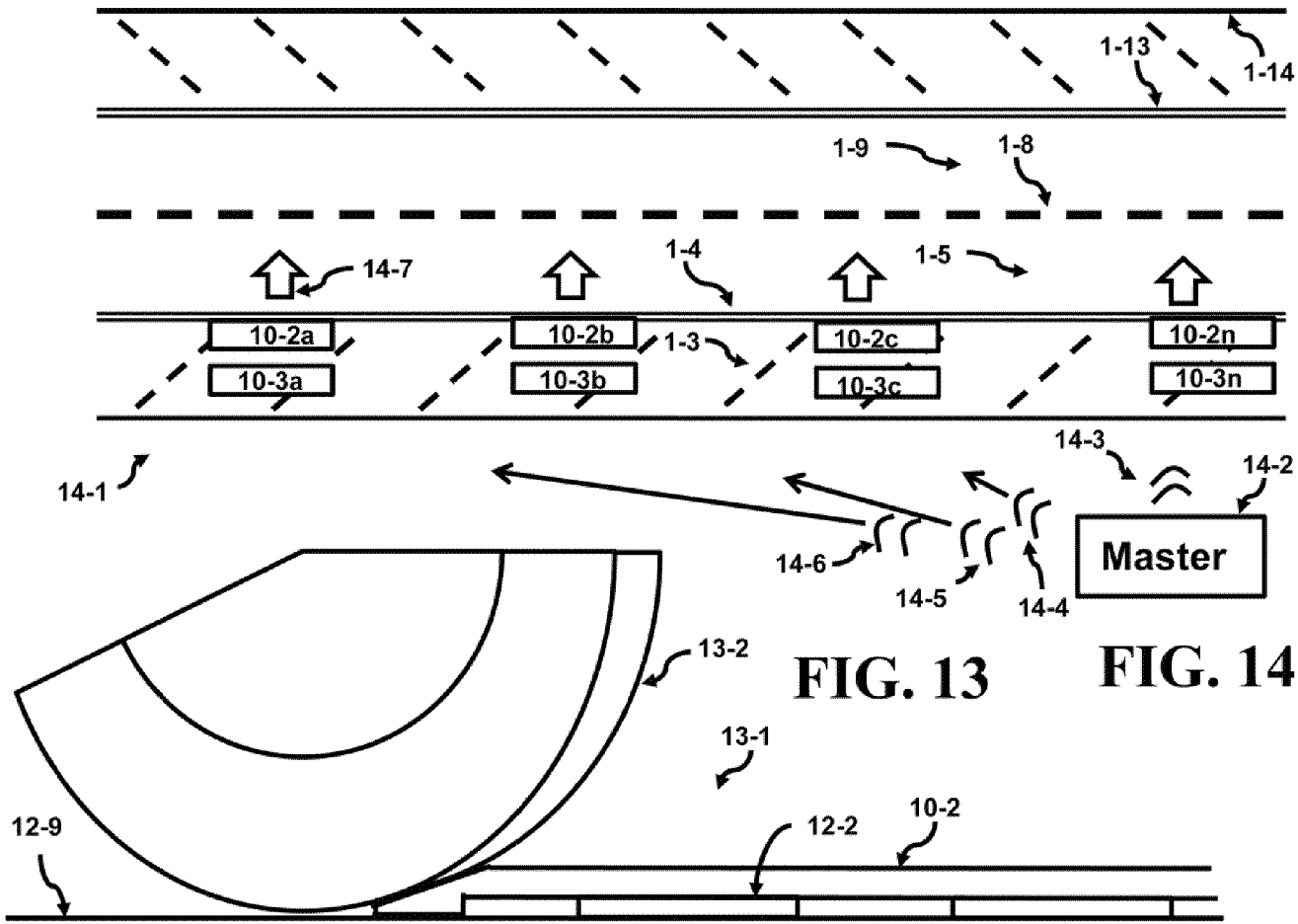
FIG. 13 depicts a tire of a vehicle rolling over the mobile flat unit.
FIG. 14*a* illustrates the top view of the southbound lanes of FIG. 10 with the mobile flat units positioned in the shoulder of the roadway.

FIG. 13 shows the off-angle view 13-1 of a vehicle's tire 13-2 rolling over the unit 10-2 that is on the road 12-9. The height of the unit is minimized and the edges are tapered to allow easy entry and exit of the tire over the unit. The unit must be built to withstand the forces of the various masses that the tires of the vehicles transfer to them.

FIG. 14*a* depicts a top view 14-1 of a master processor 14-2 controlling the mobile flat units 10-2*a* to 10-2*n* and 10-3*a* to 10-3*n*. The flat units can be positioned in the shoulder of the roadway. The control to move the units is performed wirelessly by the communications paths 14-3, 14-4, 4-5 and 14-6. As an alternative, the mobile flat units can communicate using wired connections (not shown). This control moves the units in the direction of the arrows 14-7 into lane 1-5. To simplify the drawings, the traffic of vehicles traveling over these lanes is not shown, but it is understood that the mobile flat units can be rolled over by the tires of vehicles without damaging the units. The master processor 14-2 contains all the components necessary to control the flat units, such as, wireless systems, computation systems, memory storage systems, and contact with a roadway database that described the features of the roadway. In the remaining figures of moving the mobile flat units into place, the master controller is not shown.

FIG. 14*b* depicts a top view 14-8 of the mobile flat units 10-2*a* to 10-2*n* and 10-3*a* to 10-3*n* moved closer into final position. The units are still moving in the direction 14-9 and are now located in the two lanes of the southbound lanes 1-9 and 1-5.

FIG. 14*c* shows a top view 14-10 of the mobile flat units 10-2*a* to 10-2*n* and 10-3*a* to 10-3*n* moved when they are in final position. At this point, a command from the master controller is given to extend the post as illustrated in the inset 14-11. The vehicles 14-13 now use the new lanes defined by the extended posts.

Once the traffic congestion is controlled, the mobile units are slowly moved under the master control in the opposite direction with active traffic flowing in the lanes. The movement occurs until the mobile flat units 10-2*a* to 10-2*n* are overlaying the center line 1-8 and the mobile flat units 10-3*a* to 10-3*n* are overlaying the edge line 1-4. At this point, the posts are retracted and the vehicles follow the lines in painted lines in the road. Meanwhile, the mobile flat units are moved into the shoulder 1-3 for pickup and removal.

Finally, it is understood that the above description are only illustrative of the principles of the current invention. It is understood that the various embodiments of the invention, although different, are not mutually exclusive. In accordance with these principles, those skilled in the art may devise numerous modifications without departing from the spirit and scope of the invention. For example, in place of helium balloons used to lift the shield, hydrogen can be used. Rigid rods connected to a base can be used to hold the shield in place. The mobile base units can also communicate directly with the passing vehicles to provide instructions directly to the vehicle processor located in the vehicle. Both, the rubbernecking and congestion control can be used together or individually.

What is claimed is:

1. An apparatus comprising:
a plurality of mobile flat units;
a master processor configured to control a movement of the mobile flat units, wherein a tire is able to roll over the mobile flat unit;
a highway having more than one lane;
a new set of lanes defined by a final position of the mobile flat units;
a motor to move the mobile flat units;
a local processor coupled to the motor and a wireless block configured to control the motor based on a command received from the master processor;
a post in plurality of mobile flat units is extended at the final position; and
a display screen with printed instruction located on the post of one of the plurality of mobile flat units.

2. The apparatus of claim 1, further comprising:
the post in the plurality of mobile flat units can be retracted.

3. The apparatus of claim 1, further comprising:
a communication channel established between the master processor and each of the flat units.

4. The apparatus of claim 3, wherein
the communication channel can be wired or wireless between the mobile flat units and the master processor.

5. The apparatus in each: of the mobile flat units of claim 1, further comprising:
a plurality of rubber tracks coupled to the motor and a road.

6. The apparatus in each of the mobile flat units of claim 1, further comprising:
at least one LCD (Liquid Crystal Display) or LED (Light Emitting Diode) that can display instructions.

7. A method of creating a new set of lanes comprising the steps of:
placing a plurality of mobile flat units in an initial position;
controlling a movement of the mobile flat units over a roadway by using a master processor, wherein a tire is able to roll over the mobile flat unit;
moving the mobile flat units to a final position;
creating the new set of lanes defined by the final position of the mobile flat units;
communicating information either wired or wirelessly between the master processor and each of the mobile flat units;
extending a post in the mobile flat units when they are in the final position; and
displaying a screen with printed instruction located on the post of one of the plurality of mobile flat units.

8. The method of claim 7, wherein
the initial position is located in a shoulder of the roadway.

9. The method of claim 7, further comprising:
moving the mobile flat units slowly so that the new set of lanes superimpose an original set of lanes in the roadway.

10. The method of claim 7, further comprising:
retracting the post in the mobile flat units; and
moving the mobile flat units off an active portion of the roadway.

11. An apparatus comprising:
a plurality of mobile flat units;
a master processor configured to control a movement of the mobile flat units by a wireless communication channel, wherein a tire is able to roll over the mobile flat unit;
a highway having more than one lane and one or more shoulders;
a new set of lanes defined by a final position of the mobile flat units;
a motor to move the mobile flat units;
a local processor coupled to the motor and a wireless block configured to control motor based on a command received from the master processor;
a post in the plurality of mobile flat units is extended at the final position; and
a display screen with printed instruction located on the post of one of the plurality of mobile flat units.

12. The apparatus of claim 11, further comprising:
the post in the plurality of mobile flat units can be either extended or retracted.

13. The apparatus of claim 11, wherein
the communication channel is established between the master processor and each of the flat units.

* * * * *